United States Patent [19]

Aspenwall

[11] Patent Number: 4,535,393

[45] Date of Patent: Aug. 13, 1985

[54] FLUORESCENT LAMP HOUSING

[75] Inventor: John E. Aspenwall, Lehi, Utah

[73] Assignee: Jahabow Industries, Inc., Owensville, Mo.

[21] Appl. No.: 550,228

[22] Filed: Nov. 10, 1983

[51] Int. Cl.[3] ..... F21S 3/00

[52] U.S. Cl. ..... 362/217; 362/125; 362/221; 362/260; 362/362; 362/396

[58] Field of Search ..... 362/125, 217, 221, 260, 362/362, 396

[56] References Cited

U.S. PATENT DOCUMENTS 3,064,124 11/1962 Husby et al. ..... 362/221

4,464,707 8/1984 Forrest ..... 362/221 X

*Primary Examiner*—Stephen J. Lechert, Jr.

*Attorney, Agent, or Firm*—B. Deon Criddle

[57] ABSTRACT

A fluorescent lamp housing for fluorescent tubes comprising an elongate body with a curved central back and curved legs arranged to fit closely around a fluorescent tube. A wiring chamber is isolated from a lamp chamber by an insert strip; electrical sockets are positioned at opposite ends of the lamp chamber and are held in the housing by positioning clips and end plates. The end plates are attached by screws to the clips and are attached to tubular extensions of the wiring chamber. The tubular extensions have ends press-fitted into the wiring chamber and serve as wire guides and as journals that are clamped in mounting brackets. An insertion and removal aid is preferably provided to facilitate insertion and removal of the lamp with respect to the closely fitting housing.

1 Claim, 5 Drawing Figures

FLUORESCENT LAMP HOUSING

BRIEF DESCRIPTION OF THE INVENTION

1. Field of the Invention

This invention relates to housings for fluorescent light tubes and particularly to such housings as are used in display counters and the like.

2. Prior Art

The desirability of using fluorescent lighting in display cases and the like has long been recognized. In the past the fluorescent tubes used for the purpose have generally had a large diameter tube, i.e. ten centimeters simply mounted in sockets provided for the ends thereof beneath the case work of the counters. With fluorescent tubes mounted in this manner the light from the tube is not properly directed onto goods or products displayed and, in fact, frequently shines in the eyes of persons looking into the display case or cabinet.

It has been proposed to use smaller diameter fluorescent tubes for the purpose, and such tubes have been mounted in housings that are large enough to provide adequate spacings for a user's fingers to be inserted as the tube is inserted and withdrawn. The housings with which I am familiar have been attached by screws or the like to the case work of display counters and, when mounted, are immovable. Also the housing arrangements with which I am familiar have been difficult and costly to construct and have not isolated the wiring from the lamp.

In constructing the housings large enough to permit insertion and turning of a fluorescent tube the housing is made large enough to be obtrusive and easily unscrewed when used in a display counter or cabinet.

OBJECTS OF THE INVENTION

It is a principal object of the present invention to provide a small, fluorescent tube housing that can be mounted beneath the case work of a display counter or cabinet so that a fluorescent tube placed therein will unobtrusively illuminate objects displayed in such counter or cabinet.

Other objects are to provide an attractive, low-cost easily assembled housing including mounting means for attaching the housing to the case work of a display counter or cabinet.

Still other objects are to provide a fluorescent-like fixture having a housing that can be easily angularly adjusted for optimum illumination of the contents of a display counter or cabinet in which the housing is mounted.

FEATURES OF THE INVENTION

Principal features of the invention include a small, elongate lamp housing having a curved back, and outwardly curved side walls extending from the back and terminating in converging edges such that the legs will fit closely around the sides of a fluorescent tube.

A divider strip separates the housing into an electrical chamber and a lamp chamber, and the divider strip is held in place by spring clips to which an end plate is attached with a sheet metal screw, or the like. Electrical sockets are riveted or otherwise attached to the divider strip.

Tubes, having one end press fitted into the electrical chamber project therefrom to provide guides for electrical wires and to serve as journals during angular positioning of the housing and fluorescent tube therein.

Brackets, adapted to be attached to the case work of display counters or cabinets or the like clamp the tubes to prevent undesired angular displacement of the housing or to permit controlled position changes.

Additional objects and features of the invention will become apparent from the following detailed description, drawings and claims.

THE DRAWINGS

In the drawings:

FIG. 1 is a fragmentary perspective view of the housing of the invention, with a fluorescent tube therein and shown mounted in a display counter;

FIG. 2, a fragmentary, exploded perspective view of the housing of the invention and a fluorescent tube arranged to be mounted in the housing;

FIG. 3, a section, taken on the line 3—3 of FIG. 1;

FIG. 4, a section, taken on the line 4—4 of FIG. 1; and

FIG. 5, a view like FIG. 3 showing a different mounting.

DETAILED DESCRIPTION

Figure 1:
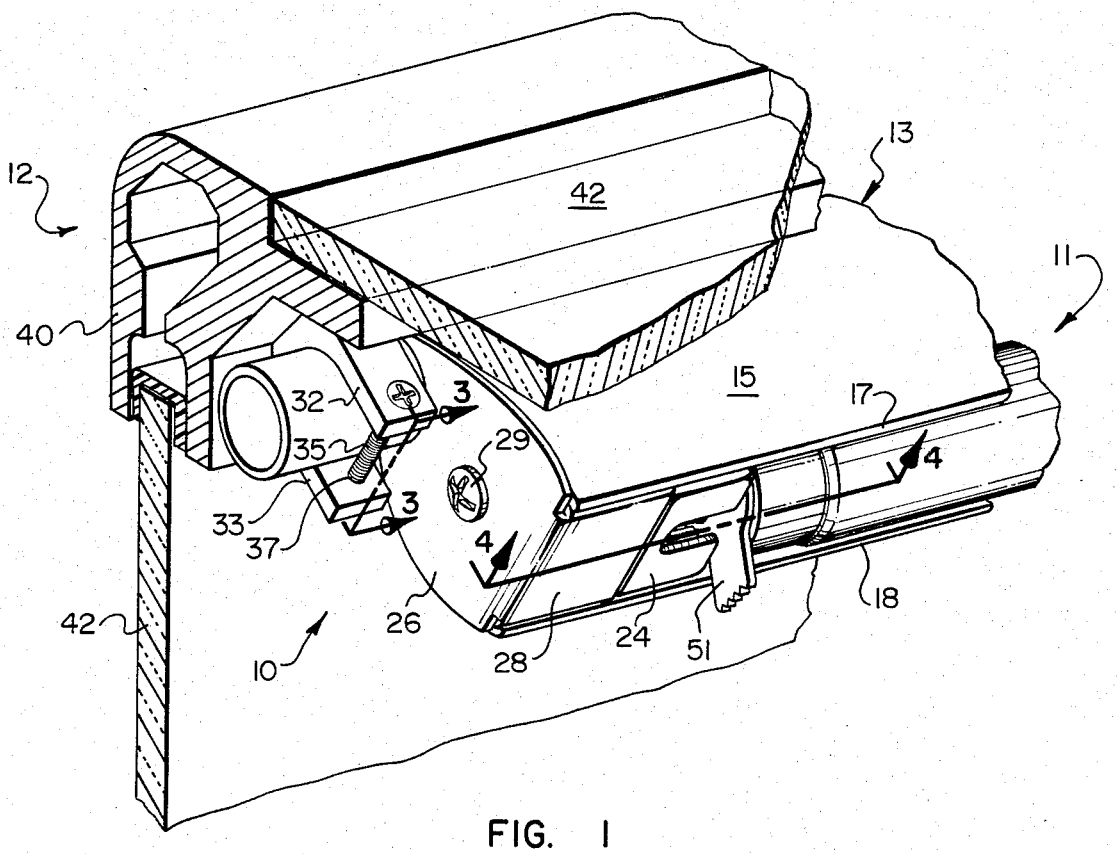
Figure 2:
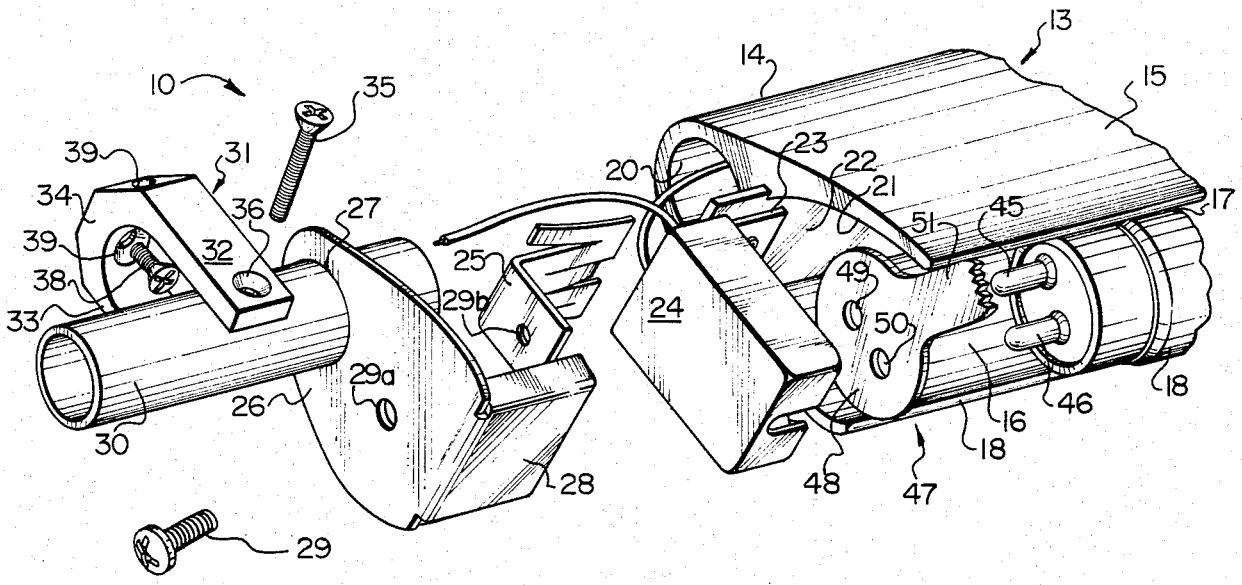
Figure 3:
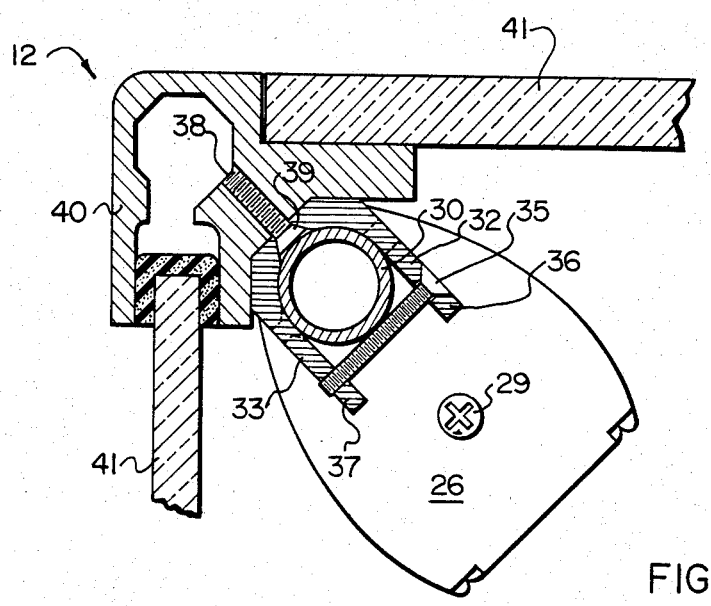

Referring now to the drawings:

In the illustrated, preferred embodiment, the fluorescent tube housing of the invention is shown generally at 10, with a fluorescent tube 11 positioned therein and the assembly mounted for use on a display counter, shown generally at 12.

The housing 10 includes a casing 13 with a curved back 14 and diverging curved legs 15 and 16 extending from the curved back and terminating in converging edges 17 and 18, respectively. A pair of opposing grooves 19 extend the length of the casing 13 inside thereof to separate an electrical chamber 20 and a lamp chamber 21. A flat divider strip 22 is inserted into the grooves 19 to separate the electrical chamber from the lamp chamber.

A base 23 of electric socket 24 is attached to each end of divider strip 22 and a resilient clip 25 is inserted into the ends of grooves 19 to hold the divider strip in place. An end plate 26 fits against each end of casing 13 and has a hole 27 therethrough arranged to be aligned with the electrical chamber 20. End plate 26 has a leg 28 that fits within the converging edges 17 and 18 to position the end cover on the casing. Each end plate is then secured to the resilient clip by a sheet metal screw 29 inserted through a hole 29*a* in the end plate and threaded into hole 29*b* in the resilient clip.

A tube 30 has one end inserted through the hole 27 and into the electrical chamber 20. The tube 30 then serves as a guide for electrical wires to the socket 24 into which the fluorescent tube 11 is plugged. While only one end of the casing 13 and fittings therefor is illustrated, it is to be understood that the other end of the casing, not shown, will have the same fittings arranged in a similar manner.

Tube 30, in addition to serving as a guide for electrical wires, also serves as part of a means for mounting the housing. Thus a mounting bracket 31 has spaced apart legs 32 and 33 that extend from a back 34 to straddle the tube 30. A screw 35 inserted through a hole 36 in leg 32 and threaded into a hole 37 in leg 33 is used to tighten the legs against the tube. A screw 38 inserted through a selected hole 39 through the back 34 of bracket 31, and threaded into supporting structure such as the case work 40 of a display counter 12 having glass walls 41, mounts the bracket 31 in place, and is easily reached by removing the top glass wall 42.

Figure 5:
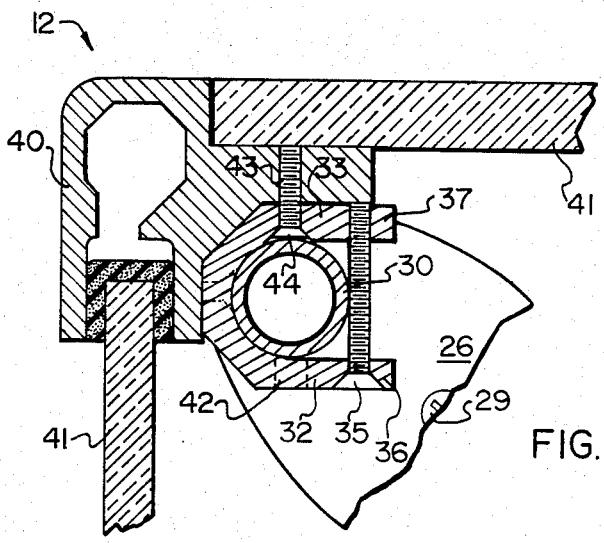
Figure 4:
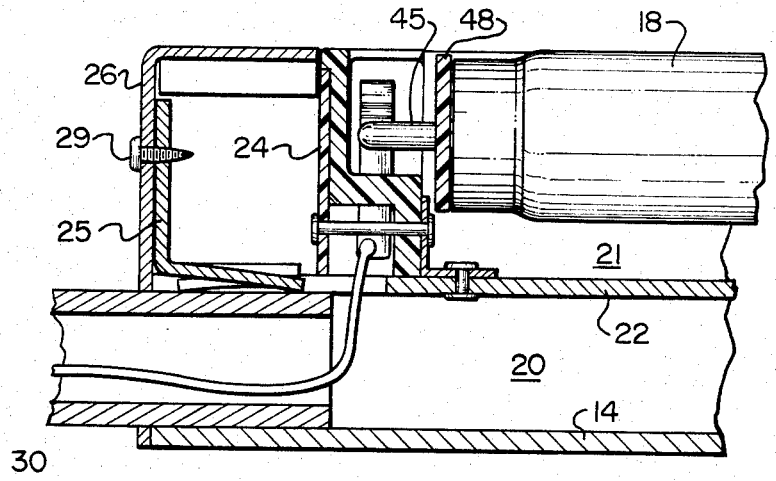

Alternatively, as shown in FIG. 5, a screwdriver blade may be inserted through an enlarged hole 42 in leg 32 of the brackets 31 to position a short screw 43 through a hole 44 in leg 33 and thread it into the case work 40. This arrangement is particularly advantageous when the top glass wall 41 of the display counter is bonded or otherwise affixed in place and positioning of and access to the mounting brackets 31 is from inside the cabinet.

It will be apparent that when a pair of the brackets 31 have been positioned and the tubes 30 of the assembled housing 10 have been placed between legs 32 and 33 of the brackets the housing can be rotated to any desired angle and screws 35 can be turned in to securely clamp the tube 30 and to hold the housing in place.

The fluorescent tube 11 is installed in the housing in the usual manner. The contact pins 45 and 46 at opposite ends of the tube are inserted into the sockets 24 and the tube is rotated to place it in engagement with electrical contacts in the sockets and to lock the tube in place.

With the disclosed housing the walls of the casing 13 fit closely around an installed tube and some difficulty may be encountered in positioning and turning the fluorescent tube. Thus, an installation and removal aid 47 may be used. The installation and removal aid is more fully disclosed in my copending U.S. application for patent entitled "Device For Positioning Fluorescent Lamps" but comprises a disk 48 with holes 49 and 50 therethrough to permit the disk to fit over the contact pins 45 and 46, respectively, of the fluorescent tube. A lever 51 projects from the disk to be manipulated by a user. Thus after the tube has been aligned and inserted the lever can be manipulated to turn the tube into its operable position. In removing the tube the lever may be manipulated to turn the tube to its removal position and, if necessary, may be used to lift the tube from the housing.

The present invention provides a low-cost, easily assembled housing that can be readily mounted to a case work of a display counter or the like. The housing can be made small and to closely fit around a fluorescent tube and is readily adapted for use with small diameter fluorescent tubes. The small size of the housing enables it to be used in an unobtrusive manner, and all electrical wiring is maintained separated from the lamp's chamber to be unobtrusive and out of the way during lamp installation and removal.

Whereas there is here illustrated and specifically described an embodiment of the invention, which is presently regarded as the best mode of the invention, it should be apparent that various changes may be made and other constructions adopted without departing from the invention subject matter particularly pointed out and claimed herebelow.

I claim:

1. A housing for a fluorescent tube comprising a casing having a curved back, curved apart, diverging legs extending from the curved back;

converging edges at the ends of the legs remote from the curved back;

means forming an electrical chamber and a lamp chamber separated from said electrical chamber in the casing by a divider strip inserted into opposing grooves in the legs;

socket means in the lamp chamber to receive the contact pins of a fluorescent tube; and mounting means for mounting the casing to a support structure, said mounting means including tubular means extending axially from opposite ends of the electrical chamber; and clamp means adapted to be fixed to said support structure, said clamp means having a bracket with a back and spaced apart legs extending from the bracket and straddling each tubular means;

a bolt extending through one leg and threaded into the other leg whereby turning of the bolt will clamp the legs to the tubular means; and means to attach the bracket to a display case or the like, said means comprising an opening through the back for inserting of a screw therethrough to be threaded into a display case, and a hole through one leg for insertion of a screw therethrough to be threaded into a display case and a larger aligned access hole through the other leg to provide for screwdriver insertion.

* * * * *